US005634185A

United States Patent [19]

Lindblad et al.

[11] Patent Number: 5,634,185

[45] Date of Patent: May 27, 1997

[54] REMOVING TONER ADDITIVE FILMS, SPOTS, COMETS AND RESIDUAL TONER ON A FLEXIBLE PLANAR MEMBER USING ULTRASONIC VIBRATIONAL ENERGY

[75] Inventors: Nero R. Lindblad, Ontario; David B. Montfort, Webster, both of N.Y.

[73] Assignee: Xerox Corporation, Stamford, Conn.

[21] Appl. No.: 671,284

[22] Filed: Jun. 27, 1996

[51] Int. Cl.$^6$ ..... G03G 21/00

[52] U.S. Cl. ..... 399/349; 399/350

[58] Field of Search ..... 355/296, 297, 355/299; 15/256.5; 430/125, 110; 118/652

[56] References Cited

U.S. PATENT DOCUMENTS

| | | | |
|---|---|---|---|
| 4,007,982 | 2/1977 | Stange | 355/299 |
| 4,076,641 | 2/1978 | Scouten et al. | 430/110 |
| 4,111,546 | 9/1978 | Maret | 355/297 |
| 4,121,947 | 10/1978 | Hemphill | 134/1 |
| 4,960,665 | 10/1990 | Elder et al. | 430/110 |
| 4,970,560 | 11/1990 | Lindblad et al. | 355/299 |
| 5,030,999 | 7/1991 | Lindblad et al. | 355/297 |
| 5,151,744 | 9/1992 | Lundy et al. | 355/296 |
| 5,153,658 | 10/1992 | Lundy et al. | 355/296 X |
| 5,298,953 | 3/1994 | Lindblad et al. | 355/299 X |
| 5,339,149 | 8/1994 | Lindblad et al. | 355/297 |
| 5,349,428 | 9/1994 | Derrick | 355/299 |
| 5,416,572 | 5/1995 | Kolb | 355/299 |
| 5,576,822 | 11/1996 | Lindblad et al. | 399/354 |

*Primary Examiner*—Arthur T. Grimley
*Assistant Examiner*—Sophia S. Chen
*Attorney, Agent, or Firm*—T. L. Fair

[57] ABSTRACT

A cleaning apparatus and color printing machine having an ultrasonic cleaner and a cleaning blade is disclosed for removing residual toner, toner additive films, spots and comets off the imaging surface. The toner additives used during development leave more than one layer of toner additive films on the surface. An ultrasonic cleaner that has a tip velocity ranging from about 1500 mm/sec to about 3000 mm/sec is used in combination with a blade that has sufficient hardness to remove the thick toner additive films without damaging the surface. The build up of toner additive films cause copy defects. The vibrational motion of the ultrasonic cleaner reduces friction between the blade and the surface and enables the dislodgment of toner additive films, spots, comets and residual toner off the surface.

18 Claims, 3 Drawing Sheets

REMOVING TONER ADDITIVE FILMS, SPOTS, COMETS AND RESIDUAL TONER ON A FLEXIBLE PLANAR MEMBER USING ULTRASONIC VIBRATIONAL ENERGY

CROSS REFERENCE

Cross reference is made to and priority is claimed from U.S. patent application Ser. No. 08/671,285, entitled "Hard Blade to Remove Toner Additive Films on the Photoreceptor", in the name of Nero R. Lindblad, assigned to the same assignee as the present application and filed concurrently herewith.

BACKGROUND OF THE INVENTION

This invention relates generally to an electrostatographic printer and copier, and more particularly, concerns a cleaning apparatus for removal of residual particles and agglomerates from an imaging surface.

The common additives used in color toners are zinc stearate (ZnSt), titanium dioxide ($TiO_2$), and silica ($SiO_2$). These are added to the toners as flow aids and charge control agents. The development process develops the toner and these additives onto the photoreceptor. When the ZnSt is deposited by the developer, it forms a uniform film covering the photoreceptor; for this reason the ZnSt film is referred to as a filming type additive. The $TiO_2$ and $SiO_2$ are very small particulate type additives, and are found on the photoreceptor as particles in lower concentrations compared to ZnSt. The particulate nature of $TiO_2$ and $SiO_2$ makes them usually easy to clean off the photoreceptor with most types of cleaners. The level of these additives on the photoreceptor depends on the development system and the concentration of additive in the toner. When the additive levels in the toner are increased, the level of additive filming on the photoreceptor also increases. At the higher additive levels we have found a very thick additive film on the photoreceptor that consists of two layers. The first layer on the photoreceptor is a thin, uniform ZnSt film. The second layer on top of the ZnSt film is a soft, thick film of ZnSt, $TiO_2$, and $SiO_2$. This soft, thick film is referred to as a "toner additive film".

The thickness, the surface texture, and the levels of additives in these two layers on the photoreceptor are determined using XPS (X-ray photoelectron spectroscopy) and SEM (scanning electron microscope). The thickness of the ZnSt film (i.e. the first layer on the photoreceptor) is usually less than 50 Å. This is a soft smooth film that gives the photoreceptor a shiny appearance. When the thickness of this film is less than 50 Å, there is no adverse effect on copy quality. The "toner additive film" (i.e. the second layer) varies in thickness from about 50 Å to one micron, and is a soft, discontinuous film that varies in thickness giving the surface a rough texture. When the thickness of this film starts to increase the background on the copy also starts to increase. Therefore, a method of removing or controlling the thickness of this "toner additive film" is needed.

The following disclosures may be relevant to various aspects of the present invention and may be briefly summarized as follows:

U.S. Pat. No. 4,007,982 to Stange discloses a cleaning apparatus, electrostatographic machine and process are provided wherein particulate material is removed from the surface of an electrostatographic imaging member by at least one blade member having an edge engaging the surface. The blade edge is vibrated at a frequency sufficiently high to substantially reduce the frictional resistance between the blade edge and imaging surface. The amplitude of the vibrations is controlled to a level which will insure sufficient conformity between the blade edge and the imaging surface so that adequate cleaning can be provided. Preferably the vibrations are carried out at ultrasonic frequencies with an amplitude less than about 0.005 inches.

U.S. Pat. No. 4,111,546 to Maret discloses an electrostatographic reproducing apparatus and process including a system for ultrasonically cleaning residual material from the imaging surface. Ultrasonic vibratory energy is applied to the air space adjacent the imaging surface to excite the air molecules for dislodging the residual material from the imaging surface. Preferably pneumatic cleaning is employed simultaneously with the ultrasonic cleaning. Alternatively a conventional mechanical cleaning system is augmented by localized vibration of the imaging surface at the cleaning station which are provided from behind the imaging surface.

U.S. Pat. No. 4,121,947 to Hemphill discloses a charged residual toner removed by simultaneously (1) exposing the photoconductive layer of the photoreceptor to light, (2) charging the photoconductive layer to the same polarity as that of the toner, (3) vibrating the photoreceptor to dislodge the toner by entraining the photoreceptor to dislodge the toner by entraining the photoreceptor about a roller while rotating the roller about an eccentric axis, and subjecting the toner to a force (e.g. vacuum or gravity) which draws the toner away from the photoreceptor.

U.S. Pat. No. 5,030,999 to Lindblad et al. discloses a piezoelectric transducer (PZT) device operating at a relatively high frequency coupled to the backside of a somewhat flexible imaging surface to cause localized vibration at a predetermined amplitude, and is positioned in close association with the imaging surface cleaning function, whereby residual toner and debris (hereinafter referred to as simply toner) is fluidized for enhanced electrostatic discharge of the toner and/or imaging surface and released from the mechanical forces adhering the toner to the imaging surface.

U.S. Pat. No. 5,339,149 to Lindblad et al. discloses a cleaning apparatus having a spots cleaning blade to remove residual agglomerations of particles from the imaging surface. The spots cleaning blade is made from a material that has a low coefficient of friction, low resilience and higher hardness than a standard spots blade. These properties enable the spots cleaning blade to provide a continuous slidable contact with the imaging surface to remove residual particles therefrom.

U.S. Pat. No. 5,349,428 to Derrick discloses a thin scraper blade member arranged in interference with, and at a low angle of attack with respect to the photoreceptor so that a maximum shearing force can be applied by the blade to the spot-causing agglomerate particles for removal thereof. A slit extends laterally from one side of the blade and parallel to the edge of the blade, so that blade tuck occurrence is minimized. The slits serve to reduce the load and eliminate forces on the ends of the blade that cause the blade to tuck under. The slit also improves the range of tolerance of interference of the blade surface with respect to the photoreceptor surface before blade tuck occurs. A relatively low load is applied to the blade, so that the problems associated with the frictional sealing contact that must occur in the normal cleaning engagement of blades with a charge retentive surface are avoided.

U.S. Pat. No. 5,416,572 to Kolb et al. discloses an agglomerate spot cleaning blade supported to a cleaning housing, thereby forming a substantially enclosed chamber, in sealing engagement with respect to the photoreceptor surface. Contact is maintained between a cleaning brush, located within a cleaning housing, and a blade, whereby rotating brush fibers remove accumulated agglomerate debris particles from the blade. A substantially air-flow free environment is maintained for removal of residual toner and debris from the photoreceptor surface and the blade, without the need for a separate vacuum/air removal system assist, or a separate manual maintenance step.

SUMMARY OF INVENTION

Briefly stated, and in accordance with one aspect of the present invention, there is provided an apparatus for cleaning particles from a surface, comprising: a housing; a holder attached to the housing; the surface, having a first surface and a second surface being opposite from one another, the first surface having multiple layers of toner additive particles thereon, the multiple layers including a first layer of toner additive particles and a second layer of toner additive particles, the first layer of toner additive particles being located between the first surface and the second layer of toner additive particles; and a blade having a cleaning edge for removing the second layer of toner additive particles from the first surface and at least a portion of the first layer of toner additive particles from the first surface, the blade having one end coupled to the holder and a free end having a cleaning edge opposite thereto, the free end being in pressure contact with the first surface having a minimal coefficient of friction therebetween enabling the free end to be in continuous slidable contact with the first surface to remove the second layer of toner additive particles from the second surface; and means for vibrational motion of the surface, the vibrational means being located directly opposite the blade contacting the second surface of the surface, the vibrational means enabling removal of the second layer of toner additive particles from the surface and the vibrational means reducing frictional contact between the blade and the surface as the blade collects the second layer of toner additive particles for disposal into a waste container the vibrational means having a tip device directly opposite the cleaning edge of the blade.

Pursuant to another aspect of the present invention, there is provided a color printing machine having a cleaner subsystem for removing particles from a surface, comprising: a housing; a holder attached to the housing; the surface, having a first surface and a second surface being opposite from one another, the first surface having multiple layers of toner additive particles thereon, the multiple layers including a first layer of toner additive particles and a second layer of toner additive particles, the first layer of toner additive particles being located between the first surface and the second layer of toner additive particles; and a blade having a cleaning edge for removing the second layer of toner additive particles from the first surface and at least a portion of the first layer of toner additive particles from the first surface, the blade having one end coupled to the holder and a free end having a cleaning edge opposite thereto, the free end being in pressure contact with the first surface having a minimal coefficient of friction therebetween enabling the free end to be in continuous slidable contact with the first surface to remove the second layer of toner additive particles from the second surface; and means for vibrational motion of the surface, the vibrational means being located directly opposite the blade contacting the second surface of the surface, the vibrational means enabling removal of the second layer of toner additive particles from the surface and the vibrational means reducing frictional contact between the blade and the surface as the blade collects the second layer of toner additive particles for disposal into a waste container, the vibrational means having a tip device directly opposite the cleaning edge of the blade.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

For a general understanding of a color electrostatographic printing or copying machine in which the present invention may be incorporated, reference is made to U.S. Pat. Nos. 4,599,285 and 4,679,929, whose contents are herein incorporated by reference, which describe the image on image process having multi-pass development with single pass transfer. Although the cleaning method and apparatus of the present invention is particularly well adapted for use in a color electrostatographic printing or copying machine, it should become evident from the following discussion, that it is equally well suited for use in a wide variety of devices and is not necessarily limited to the particular embodiments shown herein.

Figure 3:
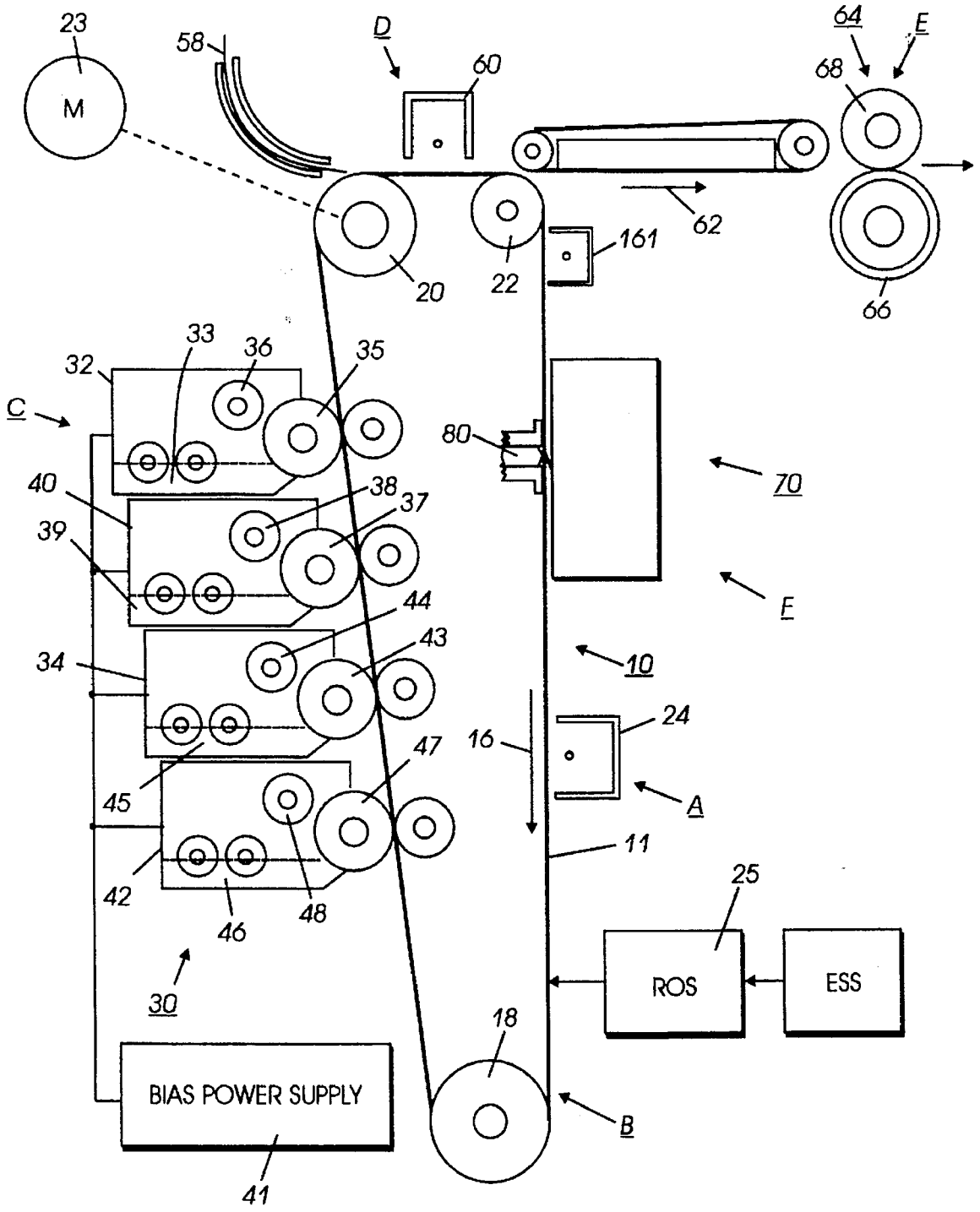
FIG. 3 is a schematic illustration of a printing apparatus incorporating the inventive features of the present invention.

Referring now to the drawings, where the showings are for the purpose of describing a preferred embodiment of the invention and not for limiting same, the various processing stations employed in the reproduction machine illustrated in FIG. 3 will be briefly described.

A reproduction machine, from which the present invention finds advantageous use, utilizes a charge retentive member in the form of the photoconductive belt 10 consisting of a photoconductive surface and an electrically conductive, light transmissive substrate mounted for movement past charging station A, and exposure station B, developer stations C, transfer station D, fusing station E and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used to provide suitable tensioning of the photoreceptor belt 10. Motor 23 rotates roller 18 to advance belt 10 in the direction of arrow 16. Roller 20 is coupled to motor 23 by suitable means such as a belt drive.

As can be seen by further reference to FIG. 3, initially successive portions of belt 10 pass through charging station A. At charging station A, a corona device such as a scorotron, corotron or dicorotron indicated generally by the reference numeral 24, charges the belt 10 to a selectively high uniform positive or negative potential. Any suitable control, well known in the art, may be employed for controlling the corona device 24.

Next, the charged portions of the photoreceptor surface are advanced through exposure station B. At exposure station B, the uniformly charged photoreceptor or charge retentive surface 10 is exposed to a laser based input and/or output scanning device 25 which causes the charge retentive surface to be discharged in accordance with the output from the scanning device (for example, a two level Raster Output Scanner (ROS)).

The photoreceptor, which is initially charged to a voltage, undergoes dark decay to a voltage level. When exposed at the exposure station B it is discharged to near zero or ground potential for the image area in all colors.

At development station C, a development system, indicated generally by the reference numeral 30, advances development materials into contact with the electrostatic latent images. The development system 30 comprises first 42, second 40, third 34 and fourth 32 developer apparatuses. (However, this number may increase or decrease depending upon the number of colors, i.e. here four colors are referred to, thus, there are four developer housings.) The first developer apparatus 42 comprises a housing containing a donor roll 47, a magnetic roller 48, and developer material 46. The second developer apparatus 40 comprises a housing containing a donor roll 43, a magnetic roller 44, and developer material 45. The third developer apparatus 34 comprises a housing containing a donor roll 37, a magnetic roller 38, and developer material 39. The fourth developer apparatus 32 comprises a housing containing a donor roll 35, a magnetic roller 36, and developer material 33. The magnetic rollers 36, 38, 44, and 48 develop toner onto donor rolls 35, 37, 43 and 47, respectively. The donor rolls 35, 37, 43, and 47 then develop the toner onto the imaging surface 11. It is noted that development housings 32, 34, 40, 42, and any subsequent development housings must be scavengeless so as not to disturb the image formed by the previous development apparatus. All four housings contain developer material 33, 39, 45, 46 of selected colors. Electrical biasing is accomplished via power supply 41, electrically connected to developer apparatuses 32, 34, 40 and 42.

Sheets of substrate or support material 58 are advanced to transfer D from a supply tray, not shown. Sheets are fed from the tray by a sheet feeder, also not shown, and advanced to transfer D through a corona charging device 60. After transfer, the sheet continues to move in the direction of arrow 62, to fusing station E.

Fusing station E includes a fuser assembly, indicated generally by the reference numeral 64, which permanently affixes the transferred toner powder images to the sheets. Preferably, fuser assembly 64 includes a heated fuser roller 66 adapted to be pressure engaged with a back-up roller 68 with the toner powder images contacting fuser roller 66. In this manner, the toner powder image is permanently affixed to the sheet.

After fusing, copy sheets are directed to a catch tray, not shown, or a finishing station for binding, stapling, collating, etc., and removal from the machine by the operator. Alternatively, the sheet may be advanced to a duplex tray (not shown) from which it will be returned to the processor for receiving a second side copy. A lead edge to trail edge reversal and an odd number of sheet inversions is generally required for presentation of the second side for copying. However, if overlay information in the form of additional or second color information is desirable on the first side of the sheet, no lead edge to trail edge reversal is required. Of course, the return of the sheets for duplex or overlay copying may also be accomplished manually. Residual toner and debris remaining on photoreceptor belt 10 after each copy is made, may be removed at cleaning station F with a brush, blade or other type of cleaning system 70. A preclean corotron 161 is located upstream from the cleaning system 70.

The ultrasonic cleaner dislodges the toner additive film on the surface of the PR, and the blade collects this toner and doctors it into a waste container. The advantages associated with the ultrasonic cleaner allow it to be used as the primary cleaner in a mid and high volume product. The ultrasonic cleaner with a blade removes everything on the photoreceptor, therefore, it would be the primary cleaner. However, it could be used as secondary cleaner with a primary cleaner in some machine applications. This latter application would become more practical in future products when the cost of the ultrasonic device decreases.

Figure 1:
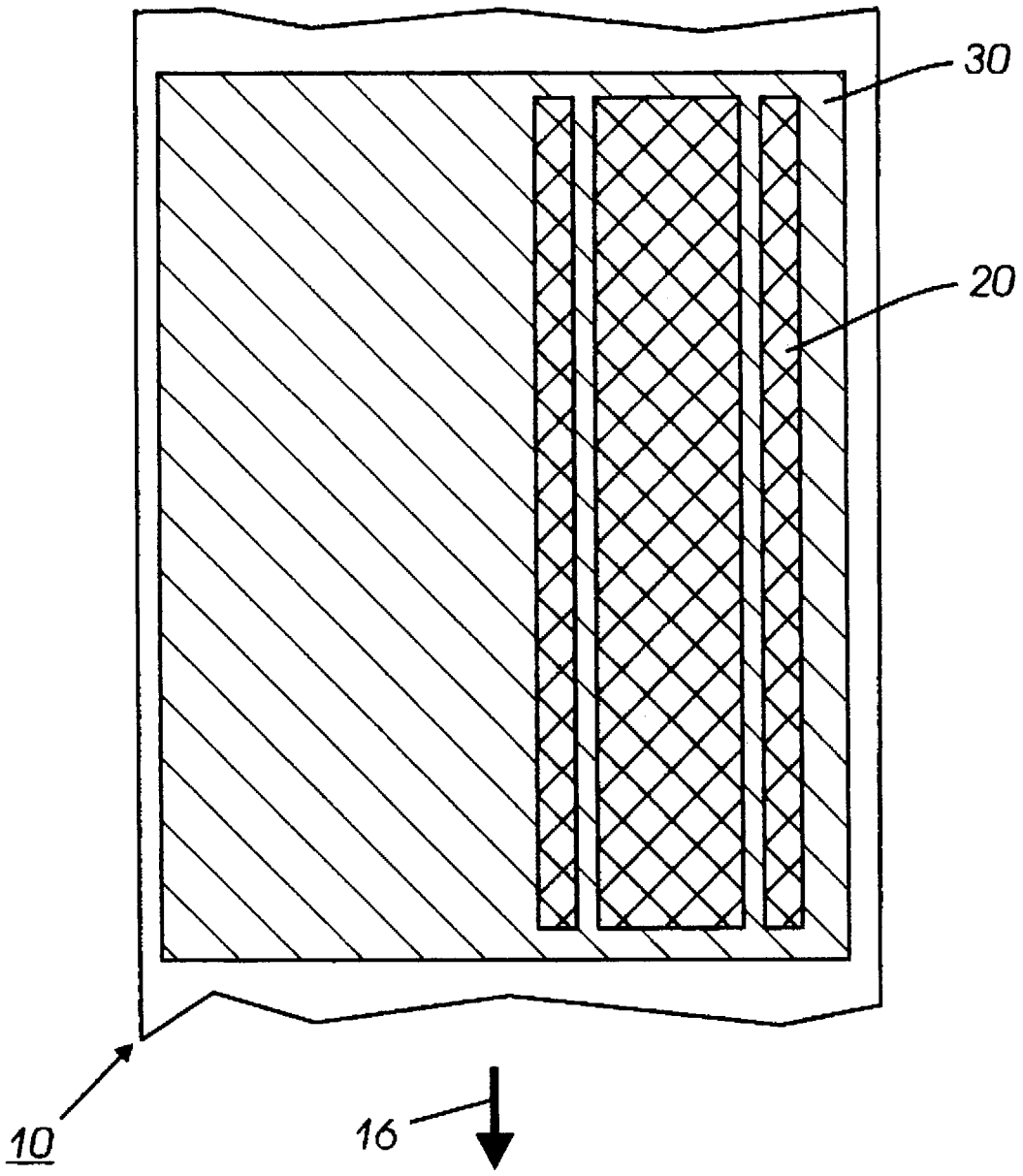
FIG. 1 shows a topical schematic cross-sectional view of the photoreceptor belt with a predominantly ZnSt film first layer and a second film layer containing $TiO_2$, $SiO_2$, and ZnSt.

Reference is now made to FIG. 1, which shows two layers of toner additive filming on the photoreceptor. The first layer 30 is a thin layer on ZnSt that covers the photoreceptor uniformly, and the second layer 20 is a thicker "toner additive film" that covers the photoreceptor discontinuously. The second layer 20 of filming is caused by the increase in the additive levels in the color toners. The XPS (X-ray photoelectron spectroscopy) and SEM (scanning electron microscope) show that the heavily coated portion of the film (i.e. the top layer 20) contained a large quantity of $TiO_2$ and $SiO_2$ and ZnSt forming a soft film. This second toner film 20, which is visible to the naked eye, is thick and forms a band type structure that runs completely around the photoreceptor belt 10. The direction of movement of the photoreceptor 10 is shown by arrow 16. This second toner additive layer 20 rests on a very thin layer 30 (i.e. first toner additive layer) made up of predominantly ZnSt with small quantities of $TiO_2$ and $SiO_2$ embedded therein.

The additive levels of the first layer 30 and second layer 20 are shown in Table 1 and Table 2 in the Appendix. Table 1 shows the elements and their atomic and weight percentages of $TiO_2$, $SiO_2$, and ZnSt, in the toner additive film that rests on the mainly ZnSt film. Table 2 shows the elements in the mainly ZnSt film 30 and the atomic and weight percentages of the elements making up the film 30 on the photoreceptor 10. The percentage of Zn in the first layer 30, is much larger than the percentage of Ti and Si. In the second layer 20, both the percentages of Zn and Si are high in comparison to their percentages in the first layer 30. The existence of these two layers was verified, experimentally, by removing the second layer 20 from the ZnSt layer 30. (i.e. Scotch tape was pressed onto the film and then removed.) The photoreceptor 10 was examined to determine if the second layer 20 had been removed from the ZnSt film layer 30. Examination of this area with XPS revealed similar percentage levels of Zn, Si, and Ti as shown in Table 2. This experiment confirmed that two film layers existed, and that the second layer can be removed from the ZnSt film.

Experimentation has also shown that the first layer 30 of mainly ZnSt, is not a cause for copy quality concern because there is no adverse effect on copy quality when the thickness of this film is less than about 50 Å. It is the second layer "toner additive film" 20 that increases background on copies. This increased background can occur in as little as a few hundred copies, under the right conditions. Poor copy quality results because the "toner additive film" forms an insulative layer on the photoreceptor that cannot be discharged. Thus, background voltage levels are too high, and toner is developed creating the background on the copy. In the present invention, this second layer 20 is removed or the thickness of this second layer 20 is controlled. A dual electrostatic brush primary cleaner, for example, does not remove or control the build up or growth of the toner additive film 30. Thus, an auxiliary cleaner, such as the present invention of an UC to dislodge the "toner additive film" and a "hard" blade collects this film for waste disposal, is needed in addition to the primary cleaner.

The UC combined with a "hard" blade sliding on the photoreceptor in a doctoring or a wiping mode removes the "toner additive film" even when the film is at its maximum thickness. The UC with a "hard" blade, in the present invention, is applicable as the primary cleaner, in mid and high volume products because the cost of the cleaner is substantially less than the cost of a dual electrostatic brush cleaner. There are several reasons for the applicability of UC with a "hard" blade as the primary cleaner in a mid or high volume product. First, the UC with a "hard" blade makes it feasible to clean residual toner, "toner additive films", spots, comets and any other unwanted debris off the photoreceptor. This hard blade replaces the use of a "soft" spot blade after the primary cleaner in the mid and high volume products. Second, the UC cyclically levitates the "hard" blade cleaning edge to reduce the blade friction without hindering the cleaning performance of the blade. The vibration of the cleaning edge also reduces photoreceptor abrasion that normally occurs with a blade that is not vibrated. The vibrational energy of the UC is directly transferred to the photoreceptor and the cleaning edge of the "hard" blade causing both the cleaning edge and the photoreceptor to vibrate. Therefore, the vibrational energy acting on the cleaning edge also acts on the residual toner, the "toner additive film", or any spots or comets on the photoreceptor. Third, the cost of the cleaner of the present invention, makes it applicable for mid volume products and very attractive for high volume products. For these reasons, the UC and "hard" blade of the present invention, provides a cleaner with excellent reliability and good cleaning performance for all types of residual toners and the unwanted debris on the photoreceptor. This is made possible only because the cleaning edge of the "hard" blade is located directly over the tip of the UC. The cleaner of the present invention could also be used as a secondary cleaner in conjunction with a primary cleaner, such as an insulative brush or a conductive brush cleaner. Further cost reduction of UC components would make the present invention even more attractive for mid and high volume products.

Figure 2:
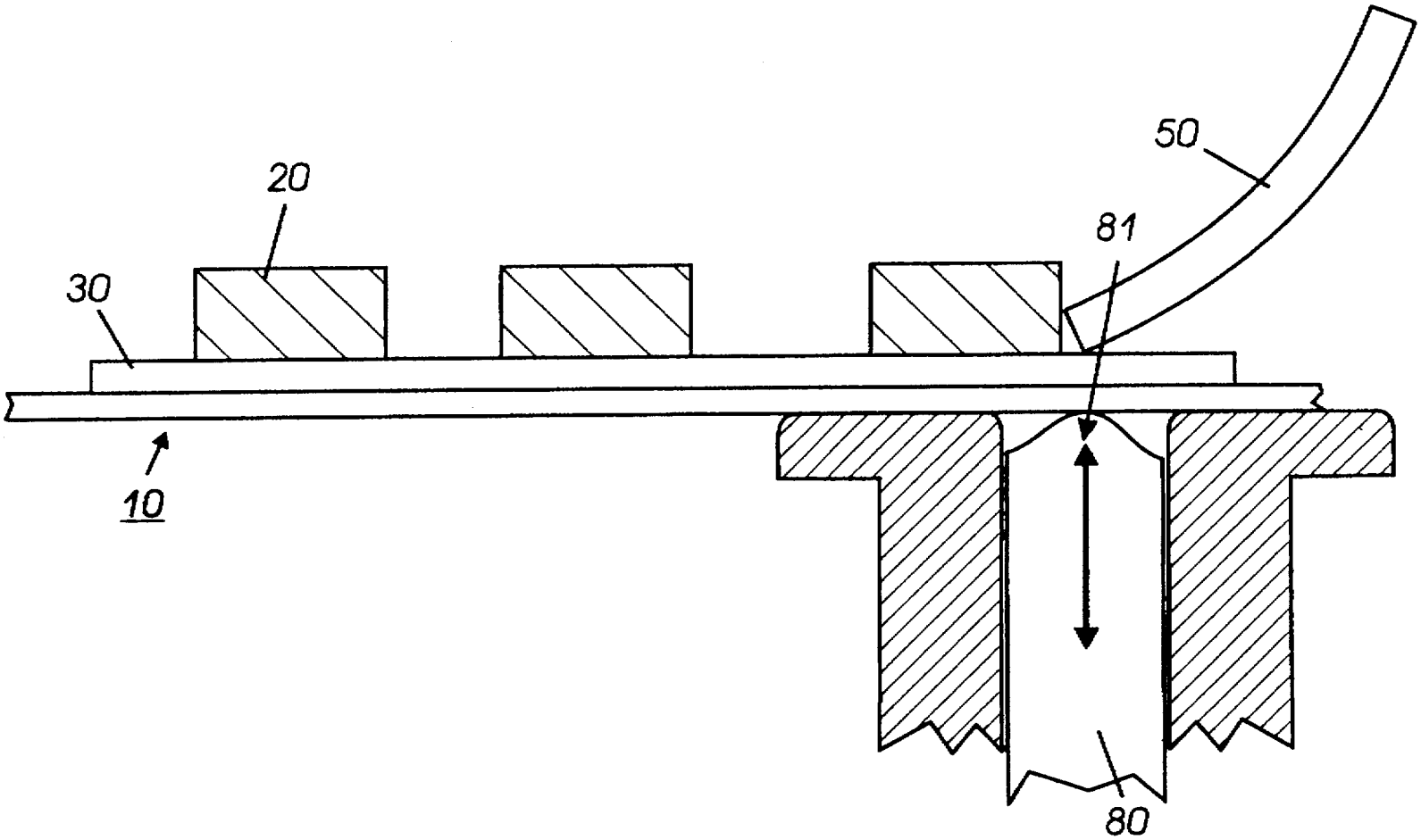
FIG. 2 shows an enlarged side schematic cross-sectional view of the present invention, with an Ultrasonic Cleaner (UC) to remove the additive films from the photoreceptor, and a "hard" blade to assist the cleaning and the collection of the detached materials.

In contrast to a brush cleaner, using an UC with a "hard" blade, enables scraping of the toner additive film 30 and the residual toner off the photoreceptor 10 simultaneously. FIG. 2 shows a "hard" blade 50, of the present invention, in a doctor mode, (e.g. a wiping mode blade could also be used) scraping the film 20 and the residual toner from the surface of the photoreceptor 10. In addition to removing the residual toner and the "toner additive films" off the photoreceptor, the UC and the "hard" blade control the thickness of the ZnSt layer by maintaining the thickness of the ZnSt film less than 50 Å. A ZnSt layer 30 of about 50 Å is advantageous for reducing friction caused by the cleaner, enhancing transfer and acting as a protective layer for the photoreceptor to reduce abrasion. When the ZnSt thickness becomes too thick (>50 Å), copy quality defects can occur. High levels of ZnSt on the photoreceptor 10 make the imaging surface too conductive, and lateral conduction of charge occurs in the latent image area. The top portion of the ZnSt film is soft and easily removed. A comparison of XPS measurements of the cleaned surface with the heavy film ZnSt area showed that the latter film thickness of approximately 300 Å was reduced to 50 Å. This change in the morphology of the heavy ZnSt film can be seen visually. The soft, milky portion of the heavy ZnSt film disappears and a shiny photoreceptor surface remains.

Materials that are used for this "hard" blade include: hard plastics (having a hardness ranging from about Rockwell R 40 up to about Rockwell M 150 value), and metals with a Rockwell hardness ranging from about C50 to C55, such as steel.

Additionally, in the present invention, the UC 80, (i.e. ultrasonic cleaner) is placed directly opposite the cleaning blade 50 on the opposite side of the photoreceptor 10, as shown in FIG. 2. The UC 80 has a vacuum that holds the moving photoreceptor 10 in contact with the UC tip 81. The photoreceptor 10 is stationary over the UC tip 10. The UC tip 81 has a velocity ranging from about 1500 mm/sec to about 3000 mm/sec for cleaning the "toner additive film". Higher tip velocity can be used, but damage may occur to the photoreceptor. When the UC 80 is turned on and off, directly over the UC tip 81 the toner additive film is dislodged. The UC 80 knocks the second film 20 off the photoreceptor 10. For this reason, urethane blade materials with a hardness greater than 85 Shore A may be used instead of a "hard" blade material as described above. When there are no "toner additive films" present on the photoreceptor 10, lower tip velocity can be used. For example, to dislodge toner particles tip velocities as low as 800 mm/sec are sufficient to remove residual toner off the photoreceptor.

Alternatively, the blade cleaning edge over the UC tip 81 applies a force that keeps the UC tip 81 in contact with the photoreceptor 10, thus eliminating the need for a vacuum as described above. Another advantage is that the blade friction is also reduced by 50% because the present invention only minimally increases the drag on the belt 10. The use of an ultrasonic cleaning (UC) device assists cleaning and reduces blade friction between the blade and the photoreceptor surface. Furthermore, comets and spots can also be removed from the photoreceptor 10 by the present invention.

In recapitulation, the present invention utilizes an UC with a "hard" blade material to remove toner additive films, spots, and comets from the photoreceptor, when color copying or color printing is being performed. At least one of these toner additive film layers is created by the additional toner additives used in color development. The UC with a tip velocity ranging from about 1500 mm/sec to about 3000 mm/sec dislodges the "toner additive film" from the surface and the scraper blade collects the film material, and this is disposed into a waste container. For this reason, the present invention is also able to remove the toner additive film using cleaning blades other than a "hard" blade material. However, the use of a hard blade material with a UC is the preferred embodiment of the present invention.

It is, therefore, apparent that there has been provided in accordance with the present invention, an UC with a "hard" blade for removing toner additive particles from the surface of the photoreceptor that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

TABLE 1

| Elements in Toner Additive Film | | |
|---|---|---|
| Element | Atomic Percent | Weight Percent |
| Zn | 3.8 | 16.7 |
| Si | 2.2 | 4.2 |
| Ti | 0.4 | 1.2 |

TABLE 2

| Elements in ZnSt Film | | |
|---|---|---|
| Element | Atomic Percent | Weight Percent |
| Zn | 1.3 | 6.1 |
| Si | 0.2 | 0.4 |
| Ti | 0.2 | 0.6 |

It is claimed:

1. An apparatus for cleaning particles from a surface, comprising:

a cleaner housing;

a holder attached to said cleaner housing;

the surface, having a first surface and a second surface being opposite from one another, the first surface having multiple layers of toner additive particles thereon, the multiple layers including a first layer of toner additive particles and a second layer of toner additive particles, the first layer of toner additive particles being located between the first surface and the second layer of toner additive particles: and a blade having a cleaning edge for removing the second layer of toner additive particles from the first surface and at least a portion of the first layer of toner additive particles from the first surface, said blade having one end coupled to said holder and a free end having a cleaning edge opposite thereto, said free end being in pressure contact with the first surface having a minimal coefficient of friction therebetween enabling said free end to be in continuous slidable contact with the first surface to remove the second layer of toner additive particles from the second surface; and means for vibrational motion of the surface, said vibrational means being located directly opposite said blade contacting the second surface of the surface, said vibrational means enabling removal of the second layer of toner additive particles from the surface and said vibrational means reducing frictional contact between said blade and the surface as said blade collects the second layer of toner additive particles for disposal into a waste container, said vibrational means having a tip device directly opposite said cleaning edge of said blade.

2. An apparatus as recited in claim 1, wherein said vibrational means comprises an ultrasonic cleaning mechanism.

3. An apparatus as recited in claim 2, wherein said ultrasonic cleaning mechanism comprises an ultrasonic housing containing an ultrasonic transducer waveguide tip device therein, having a velocity, said tip device being able to contact the second surface through an opening in said ultrasonic housing.

4. An apparatus as recited in claim 3, wherein the velocity of said tip device ranges from about 1500 mm/sec to about 3000 mm/sec.

5. An apparatus as recited in claim 4, wherein the blade in pressure contact with the surface and being adapted to remove particles therefrom, comprising a blade body including a plastic material having a Rockwell hardness ranging from about R 40 to about M 150.

6. An apparatus as recited in claim 4, wherein the blade in pressure contact with the surface and being adapted to remove particles therefrom, comprising a blade body including a steel material having a Rockwell hardness ranging from about C50 to C55.

7. An apparatus as recited in claim 4, further comprising a primary cleaner, at least partially enclosed in said cleaner housing, said blade being located upstream from said primary cleaner.

8. A color printing machine having a cleaner subsystem for removing particles from a surface, comprising:

a cleaner housing;

a holder attached to said cleaner housing;

the surface, having a first surface and a second surface being opposite from one another, the first surface having multiple layers of toner additive particles thereon, the multiple layers including a first layer of toner additive particles and a second layer of toner additive particles, the first layer of toner additive particles being located between the first surface and the second layer of toner additive particles; and a blade having a cleaning edge for removing the second layer of toner additive particles from the first surface and at least a portion of the first layer of toner additive particles from the first surface, said blade having one end coupled to said holder and a free end having a cleaning edge opposite thereto, said free end being in pressure contact with the first surface having a minimal coefficient of friction therebetween enabling said free end to be in continuous slidable contact with the first surface to remove the second layer of toner additive particles from the second surface; and means for vibrational motion of the surface, said vibrational means being located directly opposite said blade contacting the second surface of the surface, said vibrational means enabling removal of the second layer of toner additive particles from the surface and said vibrational means reducing frictional contact between said blade and the surface as said blade collects the second layer of toner additive particles for disposal into a waste container, said vibrational means having a tip device directly opposite said cleaning edge of said blade.

9. An apparatus as recited in claim 8, wherein said vibrational means comprises an ultrasonic cleaning mechanism.

10. An apparatus as recited in claim 9, wherein said ultrasonic cleaning mechanism comprises an ultrasonic housing containing said ultrasonic transducer waveguide tip device therein, having a velocity, said tip device being able to contact the second surface through an opening in said ultrasonic housing.

11. An apparatus as recited in claim 10, wherein the velocity of said tip device ranges from about 1500 mm/sec to about 3000 mm/sec.

12. An apparatus as recited in claim 11, wherein the blade in pressure contact with the surface and being adapted to remove particles therefrom, comprising a blade body including a plastic material having a Rockwell hardness ranging from about R 40 to about M 150.

13. An apparatus as recited in claim 11, wherein the blade in pressure contact with the surface and being adapted to remove particles therefrom, comprising a blade body including a steel material having a Rockwell hardness ranging from about C50 to C55.

14. An apparatus as recited in claim 11, further comprising a primary cleaner, at least partially enclosed in said cleaner housing, said blade being located upstream from said primary cleaner.

15. An apparatus for cleaning particles from a surface, comprising:

a housing;

a holder attached to said housing;

the surface, having multiple layers of toner additive particles thereon, said multiple layers including a first layer of toner additive particles and a second layer of toner additive located on said first layer of toner additive; and a blade for removing particles from the surface, the surface capable of multiple layers of toner additive particles including said first layer of toner additive and said second layer of toner additive, said blade having one end coupled to said holder and a free end opposite thereto, said free end being in pressure contact with the surface having a minimal coefficient of friction therebetween enabling said free end to be in continuous slidable contact with the surface to remove said second layer from the surface, said blade comprising a blade body including a thermoplastic material having a Rockwell hardness ranging from about R 40 to about M 150.

16. An apparatus for cleaning particles from a surface, comprising:

a housing;

a holder attached to said housing;

the surface, having multiple layers of toner additive particles thereon, said multiple layers including a first layer of toner additive particles and a second layer of toner additive located on said first layer of toner additive; and a blade for removing particles from the surface, the surface capable of multiple layers of toner additive particles including said first layer of toner additive and said second layer of toner additive, said blade having one end coupled to said holder and a free end opposite thereto, said free end being in pressure contact with the surface having a minimal coefficient of friction therebetween enabling said free end to be in continuous slidable contact with the surface to remove said second layer from the surface, said blade comprising a blade body Including a thermoset material having a Rockwell hardness ranging from about R 40 to about M 150.

17. A color printing machine having a cleaner subsystem for removing particles from the surface including toner additive layers, the cleaner subsystem comprising:

a housing;

a holder attached to said housing;

the surface, having multiple layers of toner additive particles thereon, said multiple layers including a first layer of toner additive particles and a second layer of toner additive located on said first layer of toner additive; and a blade for removing particles from the surface, the surface capable of multiple layers of toner additive particles including said first layer of toner additive and said second layer of toner additive, said blade having one end coupled to said holder and a free end opposite thereto, said free end being in pressure contact with the surface having a minimal coefficient of friction therebetween enabling said free end to be in continuous slidable contact with the surface to remove said second layer from the surface, said blade comprising a blade body including a thermoplastic material having a Rockwell hardness ranging from about R 40 to about M 150.

18. A color printing machine having a cleaner subsystem for removing particles from the surface including toner additive layers, the cleaner subsystem comprising:

a housing;

a holder attached to said housing;

the surface, having multiple layers of toner additive particles thereon, said multiple layers including a first layer of toner additive particles end a second layer of toner additive located on said first layer of toner additive; and a blade for removing particles from the surface, the surface capable of multiple layers of toner additive particles including said first layer of toner additive and said second layer of toner additive, said blade having one end coupled to said holder and a free end opposite thereto, said free end being in pressure contact with the surface having a minimal coefficient of friction therebetween enabling said free end to be in continuous slidable contact with the surface to remove said second layer from the surface, said blade comprising a blade body including a thermoset material having a Rockwell hardness ranging from about R 40 to about M 150.

* * * * *